United States Patent [19]

Akkerman

[11] Patent Number: 4,628,998

[45] Date of Patent: Dec. 16, 1986

[54] WELL APPARATUS

[75] Inventor: Neil H. Akkerman, Houston, Tex.

[73] Assignee: AVA International Corp., Houston, Tex.

[21] Appl. No.: 731,567

[22] Filed: May 6, 1985

Related U.S. Application Data

[63] Continuation-in-part of Ser. No. 708,536, Mar. 5, 1985, which is a continuation of Ser. No. 536,278, Sep. 27, 1983, abandoned, which is a continuation-in-part of Ser. No. 489,827, Apr. 29, 1983, Pat. No. 4,522,259.

[51] Int. Cl.[4] ..... E21B 23/02

[52] U.S. Cl. ..... 166/237; 166/123

[58] Field of Search ..... 166/237, 217, 113, 123, 166/125, 322, 117.5, 381, 382; 285/39

[56] References Cited

U.S. PATENT DOCUMENTS

| | | | |
|---|---|---|---|
| 2,885,011 | 5/1959 | Frost | 166/123 |
| 3,211,230 | 10/1965 | Stone, Jr. | 166/123 |
| 4,284,137 | 8/1981 | Taylor | 166/123 X |
| 4,522,259 | 6/1985 | Akkerman | 166/237 |

OTHER PUBLICATIONS

Composite Catalog of Oil Field Equipment and Services, 1970/71, pp. 3832–3833.

*Primary Examiner*—Stephen J. Novosad
*Assistant Examiner*—Thuy M. Bui
*Attorney, Agent, or Firm*—Vaden, Eickenroht, Thompson & Boulware

[57] ABSTRACT

Well apparatus is disclosed in which a well tool connected to a landing tool is lowered within a well conduit by means of a wire line running tool which, when the landing tool is so lowered, may be manipulated in order to cause locking means carried by the landing tool to be locked with a locking groove of the well conduit, and which when the landing tool is so locked, may be released therefrom for retrieval from the well conduit. The landing tool carries keys which may be landed and locked within a selected one of a plurality vertically spaced landing nipples of the conduit each of which has a cylindrical bore and a groove having an upwardly facing seat thereabout on which the key may be landed when spring pressed outwardly into the groove.

29 Claims, 22 Drawing Figures

79
83
77
75
50A
131
135
140
45
121
42
43
40
41
30
23
21
24
39
35
37
38
29
33
35A
36
142
86
85
87
89
90
122
70
120
70A
131
71
65
66
67
68
61
100
102
105
113
115
110
114
104A
134
135
131
138
137
124
80
84
79
79A
28
82
49
78
83
77
75
76
50
45
140
40
41
30
21
42
39
35
38
37
35A
62A
33
85
87
36
123
122
WT 142
121
86
85
87
49
28
50
45
40
21
30
42
32
38
29
35
37
33
JT
70
71
63
62
65
120
66
131
106
105
115
111
110
103
104A
114
134
137
80
79
83
75
135
131
42
40
30
121
39
37
38
35
35A
36
33
142
86
85
87
123

WELL APPARATUS

This application is a continuation in part of my copending application, Ser. No. 708,536, filed in Mar. 5, 1985 and entitled "Well Apparatus", which is a continuation of Ser. No. 536,278, filed Sept. 27, 1983, and entitled "Well Apparatus", and now abandoned, which in turn was a continuation in part of my copending application, Ser. No. 489,827, filed Apr. 29, 1983, and entitled "Well Apparatus" now U.S. Pat. No. 4,522,259.

This invention relates generally to well apparatus of the type in which a well tool connected to a landing tool is lowered within a well conduit by means of a wire line running tool which, when the landing tool is so lowered, may be manipulated in order to cause locking means carried by the landing tool to be locked with a locking groove of the well conduit, and which, when the landing tool is so locked, may be released therefrom for retrieval from the well conduit. More particularly, this invention relates to improved apparatus of this type in which the landing tool carries keys which may be landed and locked within a selected one of a plurality vertically spaced landing nipples of the conduit each of which has a cylindrical bore and a groove having an upwardly facing seat thereabout on which the key may be landed when spring pressed outwardly into the groove.

Typically, the well conduit of such well apparatus of this general type is connected as a part of a well string extending within a well bore, and each nipple has cylindrical bore therein which, when the locking means is locked within the locking groove in the nipple, is sealably engaged by the landing tool or the well tool connected to and lowered with the landing tool in order to close the well string or otherwise control flow therethrough. Alternatively, the well tool may be an instrument of some type which is not intended to control low through the well string and thus need not sealably engage the seal bore of the nipple.

In apparatus of this type manufactured and sold by Otis Engineering Corp., of Dallas, Tex., and known as its Type "X" equipment, the operator is able to "select" one of a plurality of vertically spaced nipples of the well conduit in which the well tool is to be landed by selective manipulation of the running tool. Thus, as shown and described on pages 3832—3 of the 1970–71 issue of the *Composite Catalog of Oil Field Equipment and Services,* the landing tool has spring means which is positioned to urge keys carried by one body part of the landing tool inwardly to a position in which the landing tool may move downwardly past the grooves, as the landing tool is lowered beneath the selected nipple. Then, as the landing tool is raised with the running tool to a position above the selected nipple, the spring means is caused to urge the keys outwardly while permitting them to be raised through the one or more of the nipples. Thus, when again lowered with the running tool to a position opposite thereto, the keys move outwardly into the groove of the selected nipple so that, in response to a downward jar, to permit one part of the running tool to be lowered with respect to the other, another part of the landing tool is moved into a position in which it holds the keys in locking position within the groove, following which the running tool may be released and raised from the landing tool in response to an upward jar to shear a pin connecting the running tool to the one part of the landing tool.

The above described Otis "X" equipment is an improvement upon other apparatus of this general type in which it is possible to select one of a plurality of nipples in which the landing tool is to be locked, because it permits selection of the nipple without having to provide selective and differing keys and grooves for this purpose. Nevertheless, it suffers the same shortcomings as other apparatus of this type in that it requires, for operation, the shearing of one or more pins, in response to jars imparted to the running tool, as well as the proper functioning of other locator parts, which may cause the landing tool to be landed and locked in an unintended location within the well string. Also, the construction and arrangement of the Otis Type "X" running and landing tools is such that, as they are lowered to land the keys in the selected nipple, the landing tool and thus the well tool are supported only by the aforementioned shear pin. As a result, if the tools should encounter an obstruction which interferes with their downward movement, they may cause the shear pin to be sheared before the keys are landed, thus permitting the well tool to be dropped into the well bore.

For the purpose of overcoming these and other problems in the case of landing well tools within an individual nipple of a well conduit—i.e., not a succession of identical nipples—the landing tools shown and described in my prior applications have sensing means movable into engagement with the seal bore or another, deliberately provided cylindrical bore in the nipple, as the landing tool is lowered by means of a running tool into the well conduit, and means which is responsive to further manipulation of the running tool following movement of the sensing means into engagement with the bore for causing normally retracted locking means carried by the well tool to be expanded into and held within the locking groove of the nipple, and when the locking means is so expanded and held releasing the running tool from connection to the landing tool, so that the running tool may be retrieved from the well conduit. Thus, this apparatus dows not require jars for shearing pins connecting the various parts of the tool, and instead enables a "soft" release of such parts with the assurance that the landing tool will be landed in the nipple, as intended.

However, such well apparatus is not intended for use in the "selective" equipment above described wherein there are vertically spaced apart nipples having cylindrical surfaces of the same diameter, and hence the landing tool could be adapted to land only within the uppermost of the nipples. It is therefore the primary object of this invention to provide well apparatus which, similarly to that of my prior applications, does not require pins which must be sheared, either to land, lock or retrieve the landing tool, or retrieve the running tool therefrom, but which nevertheless enables the nipple in which the landing tool is to be landed to be "selected", as in the Otis Tape "X" equipment, even though the nipples are not selectively different and, in fact, may be identical. More particularly, it relates to such apparatus which, in its preferred and illustrated embodiment, overcomes other shortcomings of such prior equipment of the "selective" type.

This and other objects are accomplished, in accordance with the illustrated embodiment of this invention, by apparatus which, similarly to the Otis Type "X" equipment, includes a wire line running tool, a landing tool connectible to the running tool for raising and lowering therewith within the well string, and keys each having a downwardly facing shoulder and carried by the landing tool for radial movement between inner positions in which they move past the locking grooves in the nipples of the well conduit, and outer positions in which they may move upwardly through the nipples but in which they fit within the groove of any of the nipples so that the shoulders thereof may land on the seat of the groove upon downward movement. More particularly, spring means is provided for shifting between a first position urging the keys to their inner positions, as the landing tool is lowered within the conduit, and a second position urging the keys to their outer positions, upon raising of the running tool above the selected nipple, whereby the keys are adapted to land within the groove of the selected nipple upon lowering the landing tool to dispose the keys opposite the groove. In accordance with the novel aspects of this invention, however, the apparatus also includes sensing means carried by the landing tool and urged radially outwardly to a position to engage the bore of a nipple, as the landing tool is then lowered to move the keys into a position opposite the groove of the selected nipple, and means responsive to movement of the sensing means into engagement with the bore and further lowering of the landing tool, following movement of the keys into the groove, for holding the keys within the locking groove of the selected nipple.

In accordance with the preferred and illustrated embodiment of the invention, the sensing means is retained in "non-sensing" positions, as the landing tool is raised to move the spring means to its second position, and then, when the spring means has been so moved, is urged to "sensing" position so that the landing tool is landed and locked in only the selected nipple. More particularly, the sensing means of the landing tool is engagable with the bore before the keys are lowered to a position opposite the groove of the selected nipple, and returns to non-sensing position upon return of the spring means to its first position in response to raising of the landing tool.

In accordance with a further novel aspect of the invention, the running tool has parts which are latched by laterally shiftable means which is released and then latched by other laterally shiftable means in response to raising of the landing tool to lift the keys above the groove of the selected nipple, and the spring means is held in its first position, until the release of the first laterally shiftable latching means, and then caused to shift to its second position upon release and relatching of the parts of the running tool. More particularly, the running tool has sensing means which is urged outwardly to a position to engage a nipple bore, and means responsive to raising of said last mentioned sensing means into engagement with the bore to release said first shiftable latching means and permit movement of said parts to cause said spring means may be moved from its first to its second position.

In its preferred and illustrated embodiment, the landing tool comprises a body connectible to the running tool and including a first body part and a second body part which carries the keys and is connectible to the well tool and which is vertically movable between first, second and third relative vertical positions with respect to the first body part. The spring means is shiftable from its first position urging the keys to their inner positions, when the body parts are in their third relative vertical position, to its second position urging the keys to their outer positions, when the body parts are in their first relative vertical position, and the keys are held within the groove by means on the first body part when the body parts are moved from their first to their second relative vertical position. The body parts are held in their third relative position, as the landing tool is lowered within the well conduit, and then moved from their third to their first relative vertical position in response to raising of the running tool through the selected nipple. The body parts are held in their first relative vertical position until the keys are lowered into the locking groove of the selected nipple. More particularly, the sensing means is carried by the second body part and urged radially outwardly to a position to engage the bore of a nipple as the running tool is lowered to move the body parts from their third to their first relative vertical position, and the means responsive to movement of the sensing means into engagement with the bore releases the body parts for movement from their first to their second relative vertical position upon lowering of the running tool following movement of the keys into the groove.

The means for holding the body parts against movement from their second to their first relative vertical position comprises laterally shiftable latching means on the body parts of the running tool for latching to the body parts of the landing tool and the latching means is released to permit retrieval of the running tool automatically in response to movement of the body parts of the landing tool into their second relative vertical position to hold the keys in the groove. Thus, as compared with the Otis Type "X" equipment, the well tool connected to the second body part of the landing tool cannot be inadvertently released with the landing tool by premature release of a shear pin connecting the running tool to the second body part.

Preferably, and in a manner similar to that of the well apparatus disclosed in Application, Ser. No. 708,536 the latching means for latching to the first body part is released automatically in response to movement of latching parts on the second body part into latching position with respect to the first body part.

In accordance with a further novel aspect of the invention, additional means is carried on the running tool in position to be engaged by a tool lowerable into the well conduit for releasing the running tool from the landing tool in the event the running tool is not released in response to movement of the first and second body parts of the landing tool into their second relative vertical position. The emergency release means preferably comprises an elongate member mounted for vertical reciprocation with respect to the body between an upper position and a lower position in which it engages and moves the latching means to an unlatching position, and means releasably connecting the emergency release means to the body in its upper position, said elongate member having a part engagable by a tool lowered into the well string to release said connecting means and move said member to its lower position.

In the Drawings, wherein like reference characters are used throughout to designate like parts:

FIGS. 1A, 1B, and 1C are half vertical sectional views of the upper intermediate and lower portions of well apparatus constructed in accordance with the present invention, as seen along broken lines 1A—1A of FIG. 2, and as it is lowered within the well string and into the well conduit, and with the running tool thereof latched to the body parts of the landing tool to hold them in a stretched out or third position in which the keys thereof are urged inwardly by the spring means and the sensing means of the landing tool is a non-sensing position;

FIGS. 2 to 9 are cross-sectional views of the well apparatus, as seen respectively along broken lines 2—2 and 3—3 of FIG. 1A, 4—4, 5—5, 6—6, and 7—7 of FIG. 1B and 8—8 and 9—9 of FIG. 1C;

Figure 10:
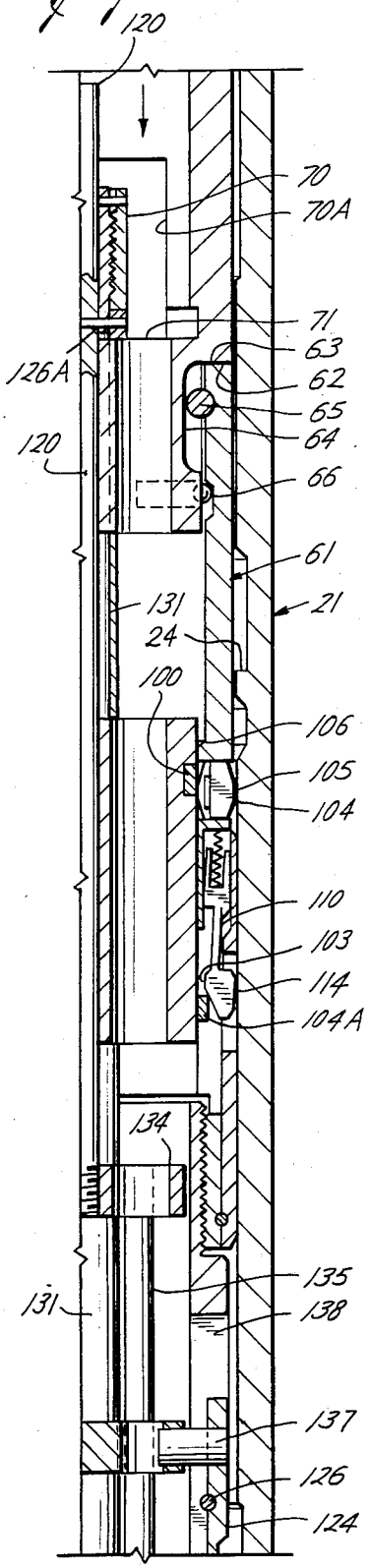
FIG. 10 is a half-vertical sectional view of a portion of the well apparatus upon further lowering thereof from the position of FIGS. 1A, 1B and 1C to move the sensing means into engagement with a bore of a nipple beneath the groove therein.
Figure 11A:
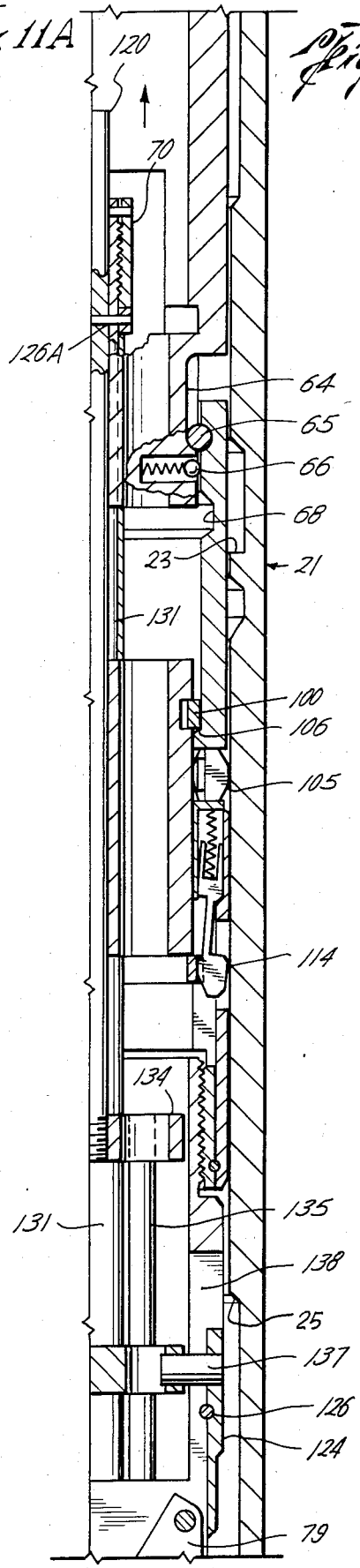
Figure 11B:
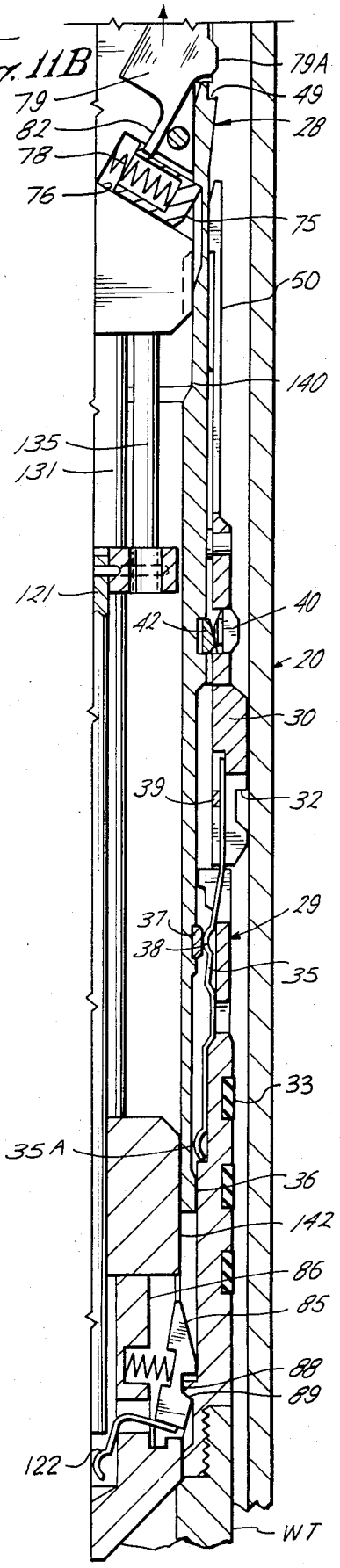
Figure 10A:
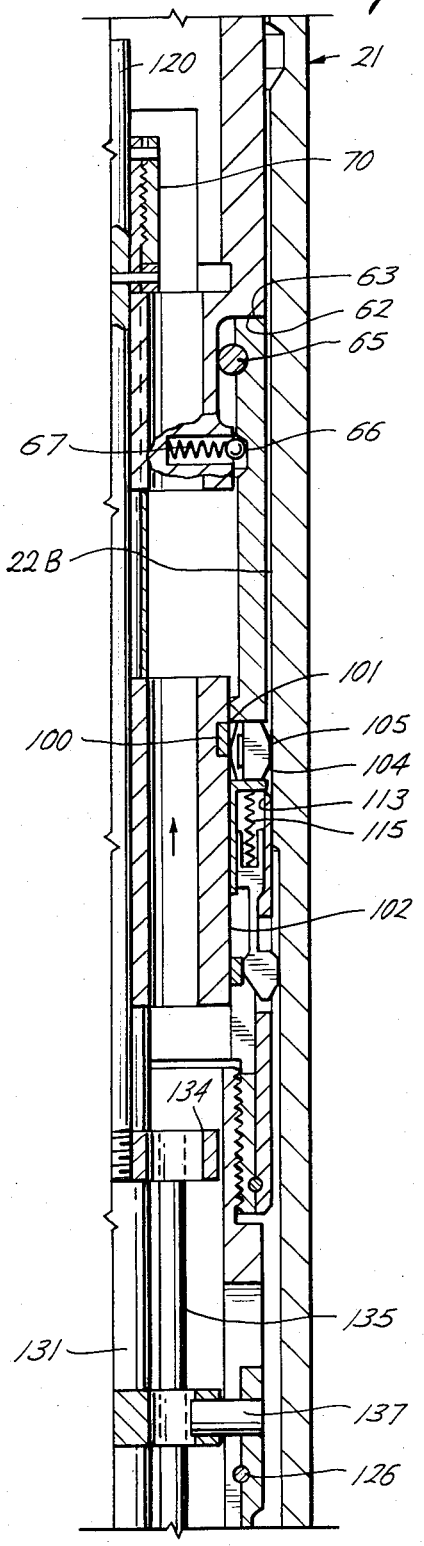
FIG. 10A is a half-sectional of the apparatus, similar to FIG. 10, but upon further lowering of the landing tool to dispose the lugs of the dogs carried by the running tool beneath a shoulder at the lower end of the nipple bore.
Figure 10B:
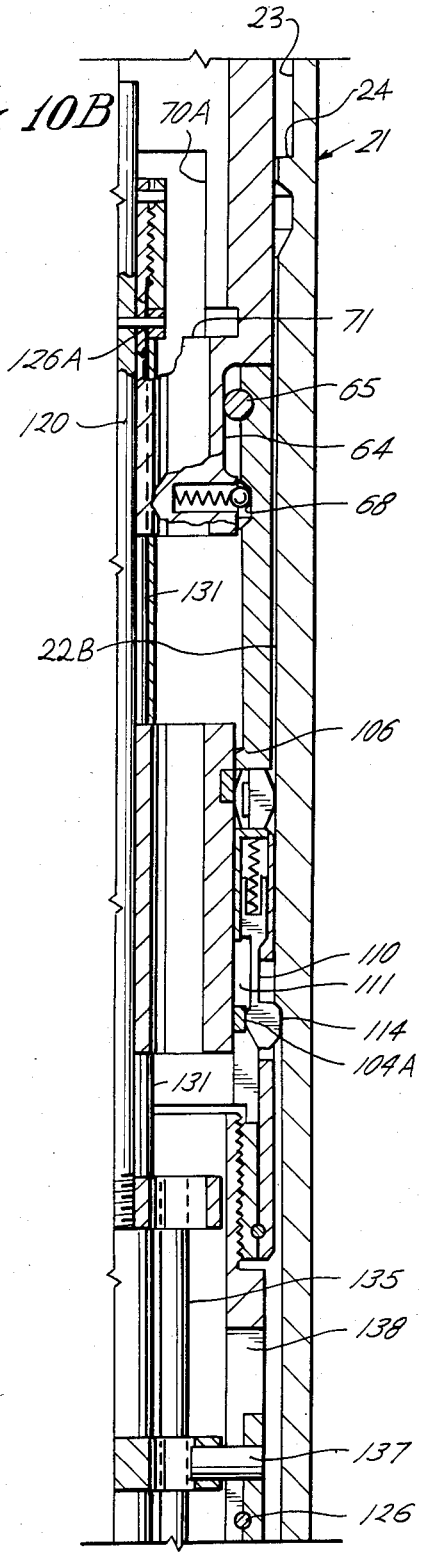
Figures 12, 13A, 13B:
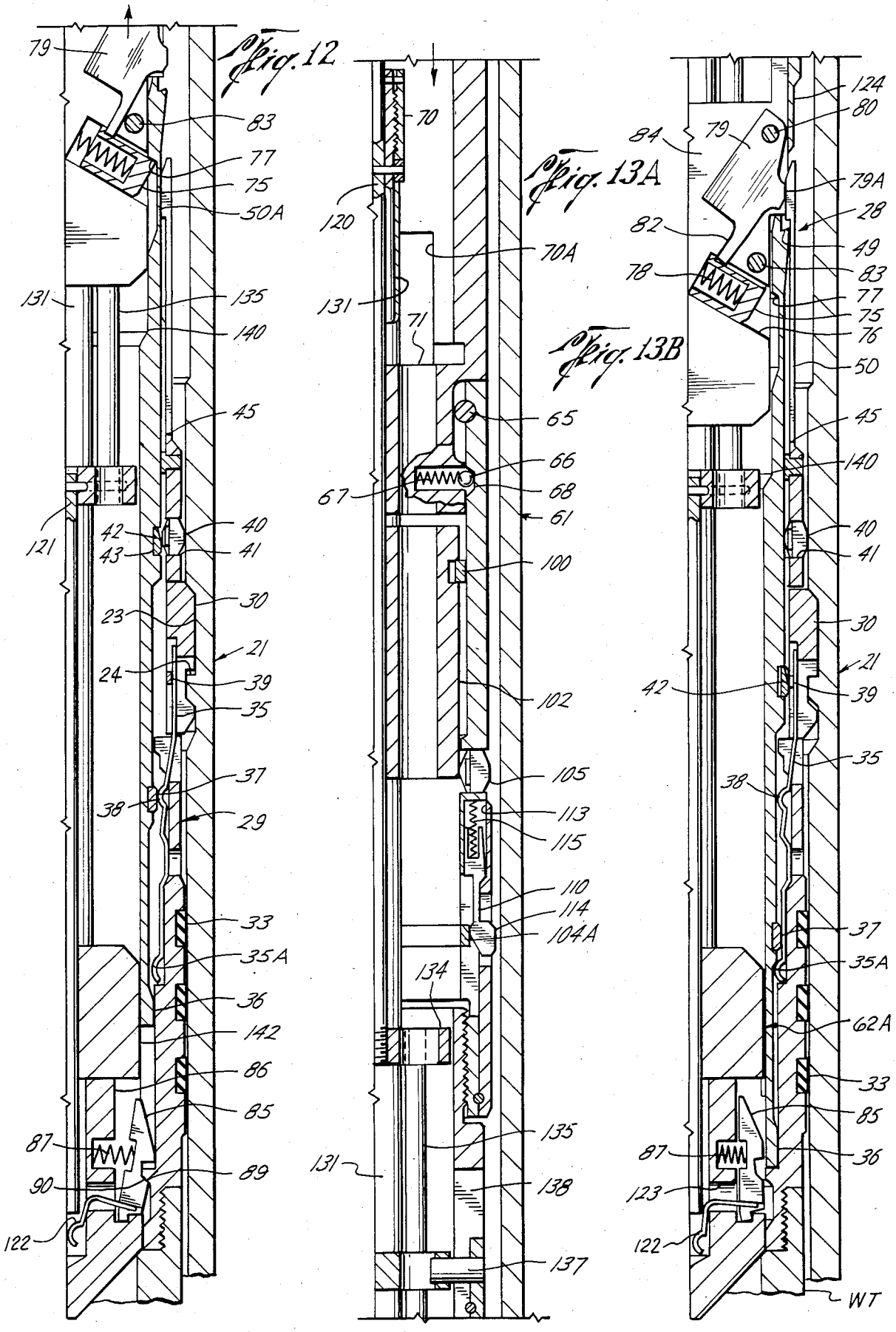
Figures 14, 15A, 15B:
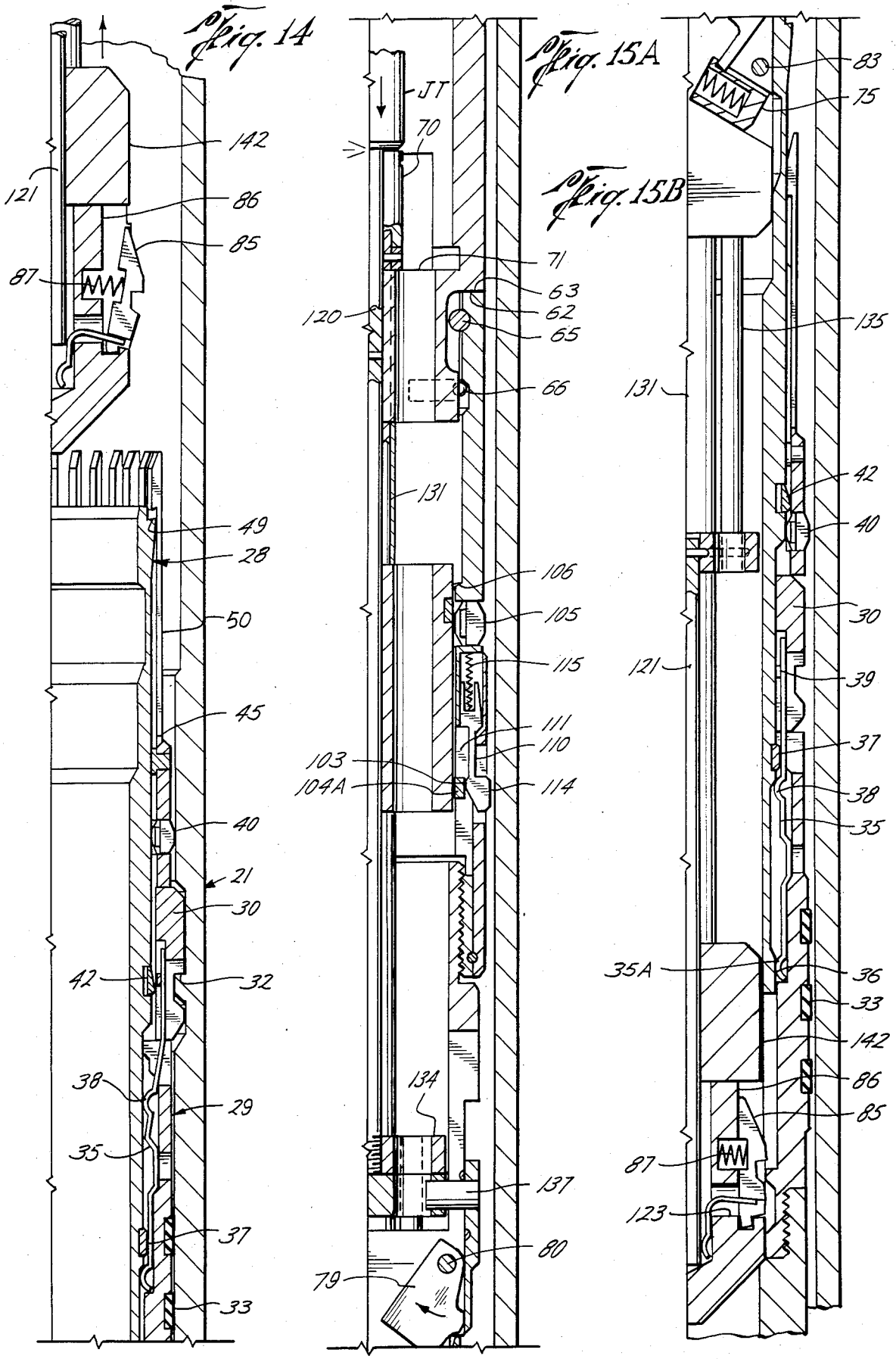

FIG. 10B is a further view of the well apparatus similar to FIGS. 10 and 10A, but upon raising of the landing tool to lift the lugs of the dogs into engagement with the shoulder, FIGS. 11A and 11B are half-sectional views of upper and lower portions of the well apparatus upon further raising of the landing tool to release and relatch body parts of the running tool in positions in which the spring means is moved to a position in which it urges the keys outwardly and the sensing means is urged outwardly to a position to engage a nipple bore;

FIG. 12 is a view of a lower portion of the apparatus shown in FIG. 11B, but upon lowering of the landing tool to a position in which the keys are opposite the groove beneath the nipple and thus move outwardly under the urging of the spring means into the groove, and the sensing is urged outwardly into engagement with the bore above the groove to release the body parts of the landing tool for movement to a position holding the keys in the groove, FIGS. 13A and 13B are half-sectional views of the well apparatus upon further lowering of the landing tool to lower one body part thereof with respect to the other body part, which is located against vertical movement by means of the keys in the groove, thereby holding the keys in the groove and causing a laterally shiftable latching part on the other body part to move into latching position with respect to the one body part and thereby release the means latching the running tool to the landing tool;

FIG. 14 is a half-sectional of the upper portion of the apparatus as the running tool is raised from the landing thereof; and FIGS. 15A and 15B are half-sectional views of the upper and lower portions of the well apparatus upon lowering of a tool into engagement with the upper end of the emergency release means supported on the running to move the latching means of the running tool to releasing position even though the body parts of the landing tool have not been moved to their locking relative position.

With reference now to the details of the above-described drawings, the well conduit into which the well apparatus is lowered, and indicated in its entirety by reference character 20, is made up of a plurality of vertically arranged nipples 21 each having upper and lower bore portions 22A and 22B, respectively. At least the lower bore portion 22B is polished and thus prepared for sealing engagement by seal means carried by the well apparatus upon landing within the well conduit, and a groove 23 is formed intermediate the upper and lower bore portions. More particularly, the groove 23 is of a construction to receive keys carried by the well apparatus and thus, as in the previously described Otis type "X" equipment, includes an upper recess having an upwardly facing seat 24 thereabout. Also, there is a downwardly facing shoulder 25 in the nipple at the lower end of the lower bore portion 22B.

Each of the vertically spaced apart grooves and bores is located at a predetermined depth within the well string, thus enabling the operator of the apparatus to determine when the well tool has been lowered to a desired level with respect to any one of the nipples. Thus, as previously described, the wireline running tool may be so manipulated as to land the well tool within a "selected" one of the nipples, even though the bore of each such nipple is of the same diameter and the grooves formed in the bore are at least sufficiently similar to receive the locking keys of the well apparatus.

As shown and as previously described, the well apparatus includes a wireline running tool 26 adapted to be raised and lowered by means of wireline (not shown) connected to its upper end, and a landing tool 27 connected to and suspended from the running tool for raising and lowering therewith within the well conduit. As also previously described, the landing tool comprises a body which is suspended from the running tool and which includes first and second parts 28 and 29 which are vertically movable with respect to one another between the extended or third relative vertical position of FIGS. 1B and 1C, a less extended or somewhat contracted first position, as shown in FIGS. 11A, 11B and 12, and a fully contracted or second position, as shown in FIG. 13B.

A well tool WT is connected to and thus suspended from the lower end of body part 29. Seal rings 33 are carried about the second body part 29 in position to sealably engage the lower well bore portion 22B when the keys 30 are landed within the groove of the nipple. Alternatively, the seal rings may be carried by the well tool WT.

Figure 9:
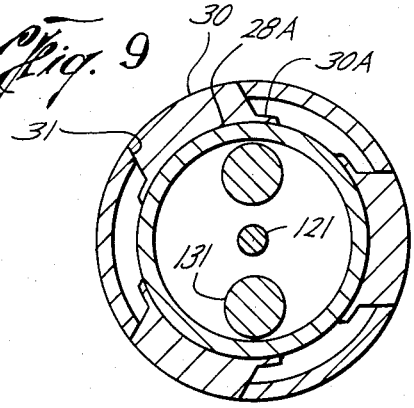

Keys 30 are carried within windows 31 formed about the second body part 29 for radial movement between the inner position of FIG. 1, wherein the well apparatus is free to move vertically within the well conduit, and outer positions, as shown in FIG. 11B, wherein the keys are adapted to slide along the well conduit until disposed opposite a groove 23 therein and then move outwardly into landed position within the groove. As shown in FIG. 9, flanges 30A at each side of each key limits the entent to which it may be urged outwardly, and a taper 30B at its upper end permits it to be raised within the well conduit and past the grooves even when it is spring pressed to its outer portion. More particularly, the keys have downwardly facing shoulders 32 thereon which are adapted to be supported on the seat 24 of the locking groove 23 when the keys are disposed within the groove.

The lower end of the first body part 28 is telescopically received within the upper end of the second body part 29 to dispose an outer surface 28A thereof on the inner sides of the keys 30 and thus limit the inward movement of the keys within the windows 31. A plurality of leaf-type springs 35 are mounted within the landing tool with their upper ends received within a slot on the inner side of the locking keys and their lower ends received within a slot about a mid-portion of the second body part beneath the window 31. In the third position of the landing tool shown in FIGS. 1B and 1C, an enlargement 36 on the lower end of the first body part 28 engages a ridge 35A on the lower end of the spring means to hold it tightly against the recess 36. At the same time, a ring 37 on the inner diameter of the first body part engages the spring above an upper ridge 38 thereon, and the upper end of the spring is held against the slot in the locking key by means of a ring 39 on the inner side of the slot. Thus, as will be understood from FIG. 1C, when the body parts are in their third relative vertical position, the spring means occupies a first position in which its upper end is forced inwardly against the ring 39 on the key 30 to urge the keys to their inner positions. However, upon raising the second body part to its first relative vertical position with respect to the first body part, as shown in FIG. 11B, for example, the enlargement 36 is lowered beneath lowermost ridge 35A on the spring 35 and the ring 37 is moved opposite the ridge 38 so that the spring means is urged to its second position in which its upper end urges the keys to their outer positions.

Figure 1A:
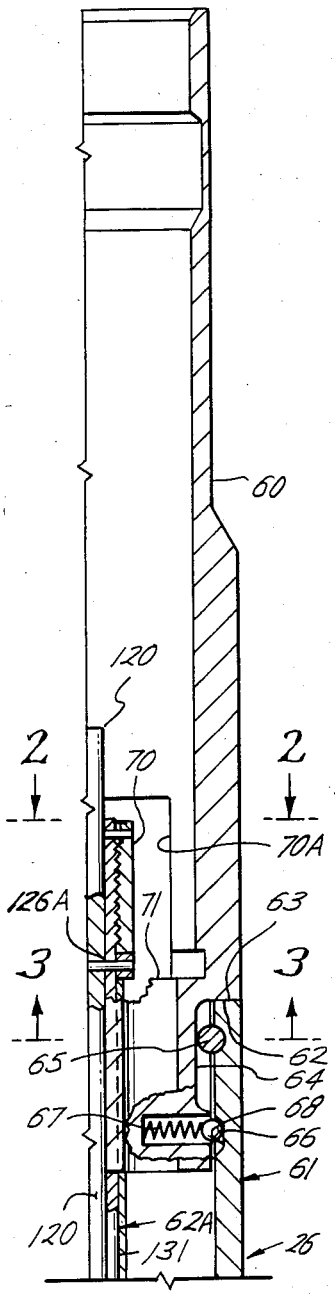
Figure 1B:
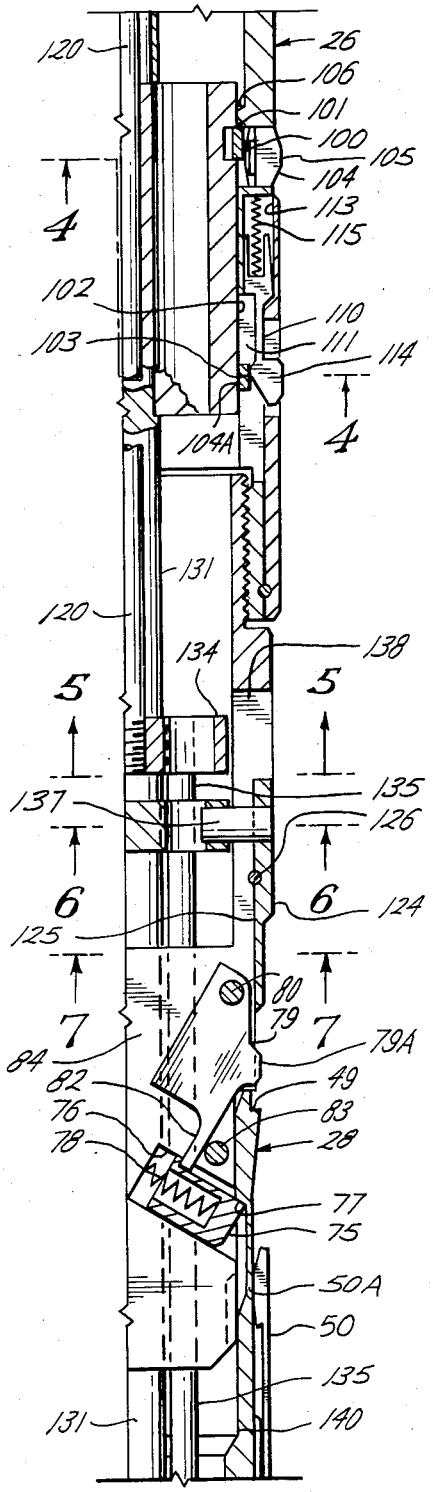
Figure 1C:
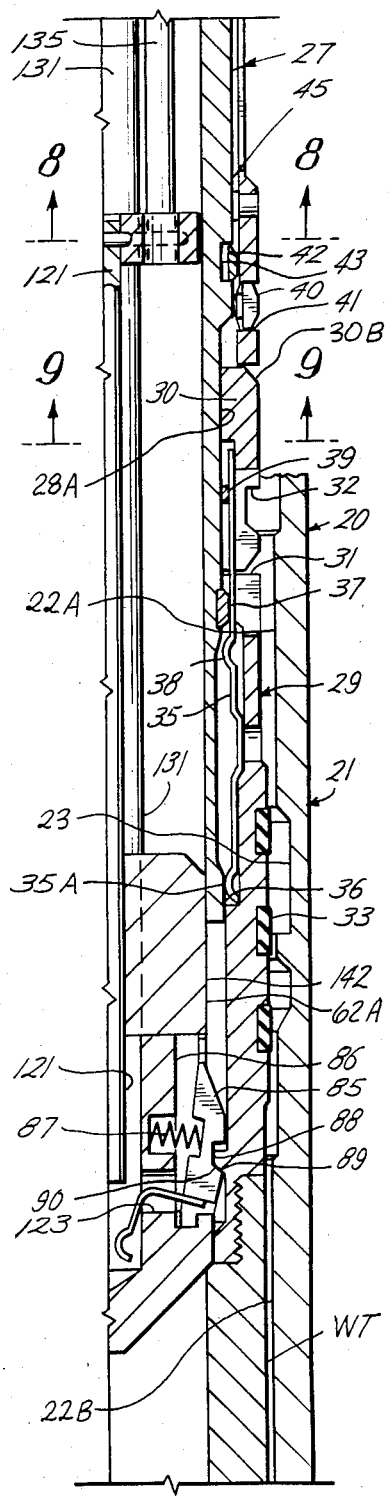

Sensing means in the form of a plurality of circumferentially spaced-apart buttons 40 are carried within ports 41 in the second body part of the landing tool and above the windows 31 for shifting laterally between non-sensing inner positions, as shown in FIG. 1C, wherein the outer ends of the buttons are substantially aligned with the outer diameter of the second body part, and sensing positions in which the outer ends of the buttons are urged outwardly to protrude from the second body part as shown in FIG. 11B, and thus are in position to engage the lower bore portion 22B as the landing tool is lowered to a position in which the keys are opposite and thus free to be urged outwardly into the groove in the nipple on which the bore is formed.

A C-ring 42 carried within a groove 43 about body part 28 is of such construction that it normally tends to expand outwardly from the groove. In the third position of the landing tool shown in FIGS. 1B and 1C, the C-ring 42 is confined within the groove by the inner diameter of second body part 29 above the buttons. As a consequence, the sensing buttons occupy their inner "non-sensing" positions when the body parts are in their third position, and thus when the spring means 35 is in its first position in which the keys are urged inwardly.

However, upon raising of the second body part of the landing tool with respect to the first body part so as to move the springs 35 to their second relative vertical positions in which they urge the keys 30 outwardly, the inner sides of the buttons 40 are moved opposite the C-ring 42 and thus urged outwardly to "sensing" position. More particularly, as shown in one of my copending applications, the C-rings are adapted to move outwardly into a groove about the inner sides of the windows 41, and thus not only urge the buttons outwardly to sensing position, as shown in FIG. 11B, but also prevent movement of the body parts from their first to their second positions. Thus, when the second body part has been moved upwardly to its first relative position with respect to the first body part, the disposal of C-ring 42 across the separation between the first and second body parts holds the second part against further upward movement with respect to the first body part.

When, however, the sensing buttons move downwardly within a nipple bore, as the keys are lowered downwardly to landed position with the landing tool as shown in FIG. 12, the buttons are forced inwardly to contract the C-ring 42, whereby the C-ring is removed from the groove and the first body part is released for downward movement with respect to the second body part and thus to its second relative vertical position with respect thereto. Thus, as shown in FIG. 13B, the C-ring is free to move downwardly with the first body part, in response to lowering of the landing tool, to positions beneath the buttons 41, and an enlarged outer diameter portion 45 of the upper end of the first body part, in which the C-ring 42 is carried, is moved within the keys 30 so as to hold them in their outer positions within the groove of the nipple.

More particularly, and as shown and described in detail in my before mentioned application Ser. No. 705,536, an upwardly facing shoulder 49 about the outer diameter of the upper end of the first body part moves downwardly beneath the lugs 50A on the upper ends of collet fingers 50 on the upper end of the second body part, so that the lugs are free to spring inwardly to positions above the shoulder 49, as shown in FIG. 13B, and thus hold the body parts of the landing tool in their second relative position, at least until such time that the landing tool is to be removed from the landing tool.

The running tool has a neck 60 at its upper end for connection to a wireline for raising and lowering therewith, and a body supported from the lower end of the neck 60 and including first and second body parts 61 and 62A releasably latched respectively to the first and second body parts of the landing tool. More particularly, and as will be described to follow, the first and second body parts of the running tool are movable vertically with respect to one another, as well as vertically with respect to the neck. Thus, the body parts of the running tool are vertically movable with respect to one another between the first position shown in FIGS. 1A–1C, for example, the second position shown in FIGS. 11A–11B, for example, and the third position shown in FIGS. 13A and 13B, for example.

The neck 60 is vertically movable with respect to the first body part between the first position shown in FIG. 1A, for example, wherein a downwardly facing shoulder 62 thereabout engages the upper end 63 of the first body part, and a raised second position with respect thereto in which the shoulder 62 is raised above the upper end 63 of the first body part. A milled flat 64 is formed about the lower end of the neck 60 which extends into the upper end of the first body part, and a pin 65 is carried on the inner side of the first body part for vertical reciprocation within the flat. When the neck is raised to its second position as shown in FIG. 11A, the lower end of the groove engages the snap ring 65 to suspend the first body part of the running tool from the neck. One or more ball detents 66 are carried by the lower end of the neck and urged outwardly by springs 67 to engage within a groove 68 about the inner side of the first body part beneath the snap ring 65 to releasably support the first body part from the neck in their first relative vertical position.

The second body part 62A of the running tool has an enlarged upper end 70 which is supported upon the upper side on the reduced lower end 71 of the neck 60 so as to be supported by the neck when the neck is in either of the first or second vertical positions with respect to the first body part shown in FIGS. 1A and 11A. As will be described in detail to follow, and as shown in the drawings, the lower end of the second body part of the running tool extends within a tubular portion of the first body part and depends from a reduced lower portion of the lower end of a first body part for extension downwardly within the inner diameter of the landing tool. In a manner to be described, the first and second body parts of the running tool are adapted to be latched to one another to prevent movement from their first to their second relative vertical positions or from their second to their first relative vertical positions. When in either first or third relative vertical positions, the first and second body parts of the running tool are latched, respectively, to the first and second body parts of the running tool. However, upon movement of the body parts of the running tool to their third position, and with respect to the neck, as shown in FIGS. 13A and 13B, the running tool is released from latching position with respect to the landing tool so that it may be raised therefrom.

The first body part of the running tool is releasably latched to the first body part of the landing tool by means of pins 75 which are slidable within slots 76 formed in a lower portion of the first body part between inner positions, in which they may be moved inwardly from beneath a downwardly facing shoulder 77 on the inner side of the upper end of the first body part 28 of the landing tool, and outer position disposed beneath the shoulder so as to support the first body part therefrom. The pins 75 are urged outwardly to latching position by means of springs 78 acting between them and the groove 76 in which they are slidable.

Figure 7:
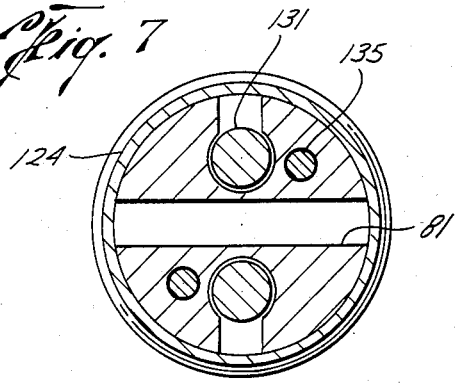

Dogs 79 are pivotally mounted on the first body part of the running tool above the pins 75 by means of pivot pins 80 extending across a central recess 81 in the lower portion of the first body part (See FIG. 7). As more fully described in my copending application, Ser. No. 708,536, an outer protrusion 79A on the dogs 79 is disposed above the upper end of the first body part of the landing tool, and a finger 82 on the lower end of each dog engages a pin 75 so that the spring 78 not only urges the pins to their outer position, but also swings the fingers 82 downwardly to swing the dogs in a counterclockwise direction in which the protrusion 79A extends above the upper end of the first body part of the landing tool. The buttons and locking dogs are located in position of FIG. 1B by engagement of the finger 82 with a pin 83 which also extends across the recess 81 in the first body part of the running tool.

The lower end of the second body part of the running tool carries latches 85 within recesses 86 therein for swinging between the position of FIG. 1C, in which the latches are latched to the second body part of the landing tool, and an inner position as shown in FIG. 15B, for example, in which the latches are released from latching position with respect to the second body part of the landing tool. The latches 85 are urged outwardly to latching position by means of springs 87 acting between them and the recess 85 in the second body part of the running tool, and have a groove 88 thereabout providing an upwardly and inwardly facing shoulder 89 adapted to engage a downwardly and inwardly tapering shoulder 90 on a rib about the second body part of the landing tool which is received within the recess 88. Thus, when the latches are urged outwardly to move the recess 88 over the rib of the second body part of the landing tool, the taper of the shoulders 89 and 90 will resist disengagement of the latch in response to an upward pull on the second body part of the running tool. When the latches are moved inwardly, in a manner to be described, their outer sides are disposed within the rib about the inner side of the second body part of the landing tool, so that the latches may be pulled upwardly therefrom in order to retrieve the running tool.

As also previously described in connection with my prior application, Ser. No. 708,536, the protrusions 79A on the dogs 79 of the latches on the first body part of the running tool are adapted to be engaged by the lugs 50A on the upper ends of the collet fingers 50 as the first body part of the landing tool is moved downwardly to its second relative vertical position with respect to the second body part. This forces the dogs to swing in a clockwise direction and thus retract the pins 75 from beneath the shoulder 77, thereby releasing the latches from latching position with respect to the first body part. At the same time, and as described above, the lower end of the first body part of the landing tool has moved downwardly to a position forcing the latches 85 inwardly against the force of the spring 87, so that the latching engagement of the second body part to the second body part of the landing tool is also released to permit the running to be raised from within the landing tool.

The first and second body parts of the running tool are releasably latched against movement from their first to their second positions by means of a C-ring 100 carried within a groove 101 about an enlarged intermediate portion 102 of the second body part which is received closely within the inner diameter of the first body part. More particularly, the C-ring 100 is of such shape that it normally expands outwardly into a groove on the inner diameter of the first body part which connects with ports or windows 104 in the first body part in which sensing buttons 105 are mounted for limited radial movement between inner and outer positions with respect to the first body part. Thus, the C-ring 100, in the first relative vertical position of the body parts of the running tool, not only urges the buttons 104 outwardly to the sensing position of FIGS. 1A, 1B, and 1C. but also, spans the separation between the enlarged portion 102 of the second body part and the inner diameter of the first body part of the running tool, thereby preventing upward vertical movement of the first body part with respect to the second body part to their second relative vertical position. Then, upon engagement of the buttons 104 with a bore of the nipple, as will be described, they are urged inwardly, to force the C-ring 100 inwardly into the groove 101, as shown for example in FIG. 10, so as to release the latching engagement between the first and second body parts of the running tool.

A second C-ring 103 carried within a groove 104 in the inner diameter of a recessed portion of the first body part of the running tool opposite the outer diameter of the enlarged portion 102 of the second body part is of such shape that it would normally expand into the groove. Thus, upon upward movement of the first body part to the position FIG. 11A, for example, the upper C-ring 100 moves outwardly from the position of FIGS. 10, 10A, and 10B into a position above an inwardly extending shoulder 106 on the upper end of an annular flange on the inner side of the first body part just above windows 104. More particularly, the C-ring 100 extends outwardly to engage the inner diameter of the first body part and thus spans he gap between the first and second body parts of the running tool, thereby preventing upward movement of the first body part with respect to the second body part and thus return of the body parts to their first relative vertical position.

When the body parts of the running tool are in their first position, C-ring 103 is held by the outer diameter of the enlarged portion 102 of the second body part fully within the groove 104A. However, when the first body part is raised with respect to the second body part, as shown in FIG. 11A, for example, the lower C-ring 103 is free to be contracted inwardly to a position beneath the lower end of the enlarged portion 102 of the second body part.

A plurality of circumferentially spaced-apart dogs 110 are mounted within recesses 111 on the inner diameter of the first body part of the running tool opposite the lower end of enlarged portion 102 of the second body portion. More particularly, the upper ends of the dogs 101 are supported within a further enlarged recess 113 to permit them to swing about a horizontal axis between positions in which lugs 114 on the lower ends of the dogs occupy inner positions substantially aligned with the outer diameter of the first body part of the running tool and outer positions in which they project outwardly therefrom. More particularly, in the first relative vertical position of the body parts shown in FIGS. 1A, 1B, and 1C, for example, the inner sides of the lugs 114 are opposite the C-ring 103 so as to be held in their outer positions. The dogs are urged downwardly to the position described by means of coil springs 115 which are yieldable in response to an upward force on the dogs to permit the lugs to move upwardly, as tapered surfaces on their inner sides slide over the upper outer edge of the C-ring 103, and thus to their inner positions, as shown in FIG. 10, wherein their outer surfaces are generally aligned with the outer diameter of the first body of the running tool.

The dogs cooperate with the well conduit so as to enable the first and second body parts of the running tool to be moved from their first to their second relative vertical position in which they are automatically latched, as shown in FIG. 11A. Thus, as the dogs move downwardly within a bore of the well conduit, upon lowering of the landing tool with the running tool, the frictional engagement of the lugs 114 with the bore will cause the lugs to move upwardly to the positions of FIGS. 10, 10A, 10B. At the same time, and as also shown in FIGS. 10 and 10A, the sensing buttons 105 have moved into the bore so as to contract the C-ring 100 and thus release the body parts of the running tool for relative vertical movement from their first to their second positions.

More particularly, and as shown in FIG. 10A, the landing tool is lowered with the running tool through the bore of a nipple until the lugs 114 of the dogs are beneath the shoulder 25 beneath the lower bore portion 22B. At this time, the springs 115 are effective to move the dogs downwardly and over the C-ring 103 into the outer position of FIG. 10A. The running tool is then raised to lift the lugs of the dogs into engagement with the shoulder 25, thereby preventing further upward movement of the first body part of the running tool on which the dogs are carried. However, as previously described, the neck 60 of the running tool is free to move a limited distance upwardly with respect to the first body part to the extent that the pin 65 is free to move downwardly within the flat 64. Consequently, an upward strain on the wire line supporting the running tool will release the detent 66 and thus permit the second body part of the running tool to be raised with the neck and with respect to the first part thereof, and into its second position in which the C-ring 100 is lifted to a position in which it latches the body parts against movement back to their position. More particularly, the lifting of the second body part with respect to the first body part of the running tool will permit the C-ring 103 to be moved inwardly by the lugs of the dogs to the extent necessary to permit the lugs 114 of the locking dogs to be moved to their inner positions and thus to be free to move upwardly past the shoulder 25.

Figure 4:
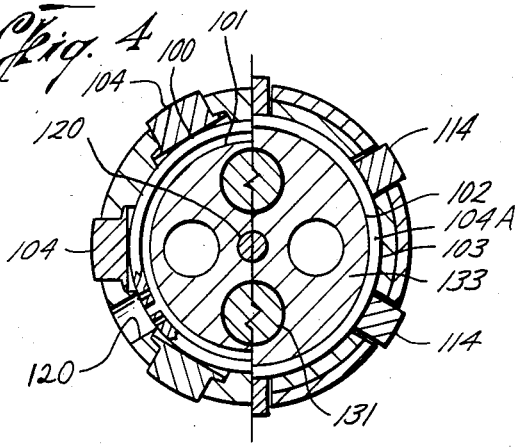

When the running tool has been released from the landing tool, and retrieved from the well string, it may be easily and quickly returned to a position for relatching to a landing tool. Thus, a window 120 (see FIG. 4) is formed in the side of the first body part of the running tool opposite the C-ring 100 when the body parts of the running tool are in their second position, as shown in FIG. 11A. This permits a suitable tool to be passed through the window to engage the free ends of the C-ring and thus contract the C-ring so that it is pulled into the groove 101, so that the first body part may be raised with respect to the second body part back to the first position of FIGS. 1A, 1B, and 1C wherein the C-ring 100 moves into the groove about the inner sides of the buttons 104 to hold the body parts against movement from their first to their second position.

At the same time, of course, raising of the first body part will enable the back sides of the lugs 114 of the dogs 110 to move upwardly over the C-ring 103, and then permit the C-ring to expand outwardly back into the groove 104A on the inner diameter of the first body part of the running tool, as shown in FIGS. 1A, 1B, and 1C. Additionally, the neck 60 of the running tool is lowered with respect to the first body part of the running tool so as to return it from its FIG. 11A position to its FIG. 1A position. When it is returned to the first position of FIG. 1A, detents 66 carried by the neck 60 will move into the groove 68, thereby releasably retaining the neck in a position in which the shoulder 62 thereabout is engaged with the upper end 63 of the first body part of the running tool. As a result, the first and second body parts of the running tool are returned to positions in which they will hold a landing tool in its fully stretched or third position when the running tool body parts are latched to the first and second body parts of the landing tool.

With reference now to the overall operation of the well apparatus for the purpose of landing and locking the landing tool within the bore of a "selected" nipple of the well conduit, the running tool and landing tool are first lowered through the well string and into the well conduit with their parts connected to one another in the position shown in FIGS. 1A, 1B, and 1C. Thus, at this time, the neck 60 is releasably held in a lower limited position with respect to the first body part, and the first and second body parts are releasably latched in their first relative vertical position to dispose the C-ring 101 in the groove on the inner side of sensing buttons 104, and thus urge the buttons outwardly to bore sensing position. At the same time, the first and second parts of the running tool are releasably latched to the first and second body parts of the landing tool to hold such parts of the landing tool in their third relative vertical position wherein the C-ring 40 is above the sensing buttons 41, so that that the buttons are in "non-sensing" position, and wherein the springs 35 are so positioned with respect to the body parts of the landing tool as to urge the landing keys 30 to their inner positions.

As will be understood from the foregoing description, the landing tool continues to be lowered with the running tool until the sensing buttons 40 of the landing tool are beneath the bore of the selected nipple, and, as shown in FIG. 10, the sensing buttons 104 of the running tool are within the lower bore portion 22B of a nipple, whether that bore is within the selected nipple or some other nipple therebelow. As the landing tool moves downwardly through successive nipples, the buttons 104 will be intermittently moved to their inner positions so as to contract the C-ring 100, and thus release the body parts of the running tool for movement from their first to their second relative vertical position. However, the body parts of the running tool will remain in their first relative vertical position, so that the first and second parts of the landing tool also will remain in their third relative vertical position, as the running tool continues to be lowered until the lugs 114 on the dogs 110 are beneath a shoulder 25 beneath the bore, as shown in FIG. 10B.

As previously described, when the dogs are raised to engage the lugs with shoulder 25, as shown in FIG. 10C, the sensing buttons of the running tool are in the lower bore portion of the nipple above the shoulder so as to retain the C-ring 100 collapsed. Thus, as the wireline continues to be raised, the detent balls 66 of the neck 60 will collapse to permit the neck to be raised to the second relative vertical position with respect to the first body part of the running tool, and thus lift the second body part with respect to the first body part of the running tool, which is held downwardly by the dogs, to the position of FIG. 11A in which they are automatically latched against return from their second to their first such position. As shown, this second position of neck 60 is determined by the engagement of the lower end of flat 64 with pin 65. Raising of the second body part of the running tool will, through the lower latches 85, also raise the second body part of the landing tool upwardly with respect to the first body part thereof, which is latched to the first body part of the running tool, so as to move the sensing buttons 40 of the landing tool into positions opposite the C-ring 42, and further shift the springs 35 to the position shown in FIG. 11B. Consequently, and as previously described, the buttons 40 are yieldably urged outwardly to bore sensing position, and the landing keys 30 are yieldably urged to their outer positions for sliding along the inner diameter of the well conduit.

As the landing tool continues to be raised with the running tool to a level in which the outwardly urged landing keys are opposite the groove 23 in the bore of the nipple thereabove, the sensing buttons and dogs will be forced inwardly to permit them to pass the bore of the nipple until the keys are opposite the groove in the nipple, as shown in FIG. 12, at which time they will snap outwardly into the groove. If this is the groove of the "selected" nipple, and the keys have been raised to a position a short distance above the groove, the landing tool is lowered so as to cause the keys to land within the groove by engagement of the landing shoulder 32 thereabout with the upwardly facing shoulder 24 of the groove. Since the sensing buttons 40 are engaged with the upper bore portion 22B, and the C-ring 42 is contracted into its groove, continued downward movement of the wireline will lower the neck 60 of the running tool from its upper to its lower position with respect to the first part thereof, and thus with respect to the second body part of the landing tool, which is now held against downward movement by the keys, the second body part of the running tool being held against vertical movement with respect to that of landing tool by engagement of its latches 85 with the upper end of the rib about the inner diameter of the lower end of the second body part As the neck moves downwardly, its shoulder 62 will engage the upper end 63 of the first body part to lower the first body part from its first position with respect to the second body part to its second body position with respect thereto wherein, as shown in FIG. 13A and 13B, the enlarged lugs on the upper ends of the collet finger 50 will move upwardly over and inwardly above the upwardly facing shoulder 49 about the first body part to latch the body parts in their second position. Also, the second body part will move the enlarged outer diameter portion 45 thereof and C-ring 40 into position behind the locking dogs so as to hold the locking keys outwardly in the groove of the selected nipple. During this time, C-ring 100 has moved upwardly along the inner diameter of the first body part of the running tool above shoulder 106.

As shown, the inward flexing of the upper ends of the collet fingers also swings the latches 79 in a clockwise direction to withdraw the pins 75 and thus release the latching engagement of the first body part of the running tool to the first body part of the landing tool. Also, the lower end 36 of the first body part of the landing tool will force the lower latches 85 carried by the second body part of the running tool inwardly thereby and release their latching engagement with the second body part of the landing tool. At this time then, the running tool is fully released from the landing tool, whereby it may be raised upwardly therefrom, as indicated in FIG. 14.

As previously described, a means is also provided for releasing the running tool from latching engagement with the landing tool in the event the body parts of the landing tool are not moved downwardly from their first to their second position to automatically release the running tool. This may occur, for example, in the event the landing tool body parts are jammed against such movement. Alternatively, of course, the first body part of the running tool may also be prevented from movement from the position of FIGS. 11A and 11B to the position of FIGS. 13A and 13B.

More particularly, the means for releasing the running tool in these emergency conditions is mounted on the running tool in position to be actuated in response to the lowering of a tool JT (FIG. 13A) through the neck 60 of the running tool upon release of the wireline connected thereto. Thus, the means for so releasing the running tool comprises an elongate member which is releasably mounted on the running tool (FIGS. 1A to 1C) in an upper position in which a rod 120 at its upper end extends through and above the upper enlarged end 70 of the second body part of the running tool, and a rod 121 at its lower end is located above triggers 122 which are mounted within slots 123 in the lower end of the second body part of the running tool and connected at their outer end to the lower ends of the latches 85. Upon release and lowering of the elongate member from the upper position of to the lower position of FIGS. 15A and 15B, the triggers are engaged and swung by the lower end of the lower rod 121 in a counterclockwise direction so as to in turn swing the latches 85 in a counterclockwise direction and thus into the recess 86 to release from the second body part of the landing tool, as shown in FIG. 15B.

The elongate member of the emergency release means also includes a sleeve 124 which is disposed about a recessed portion 125 of the outer diameter of the first body part of the running tool above the outer protrusions 79A of the latches 79. This sleeve is releasably connected to the first body part of the running tool by means of a shear pin 126, and the upper rod is releasably connected to the enlarged upper end 70 of the second body of the running tool by a shear pin 126A. The pin 126A is sheared in response to a downward jar imparted to the rod 120 by tool JT to permit it to be moved downward to cause an enlargement thereon to jar downwardly on a plate 136 connected to the ring 124. This shears pin 126 to permit ring 124 to be moved downwardly with the rod and over and about the protrusions on the latches 79, as shown in FIG. 15A. As a result, the pins 75 are withdrawn to release the latching engagement of the first body part of the running tool to the first part of the landing tool, whereby the running tool is free to be moved upwardly.

Figure 2:
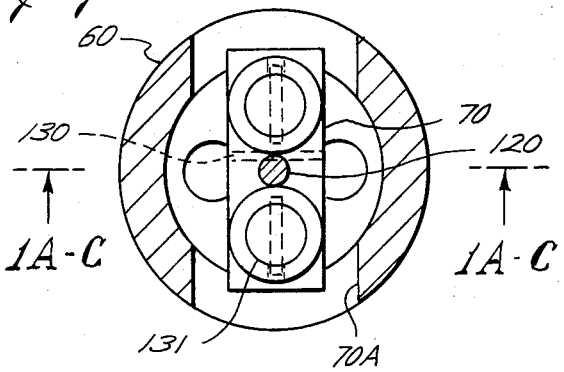
Figure 3:
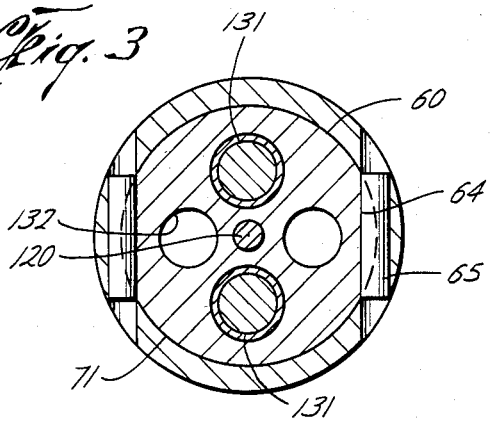

As shown in FIG. 2, the upper rod 120 is connected by the shear pin 126 to a plate which extends laterally between openings in the opposite sides of the neck 60 and which provides the enlarged upper end 70 of the second body part of the running tool. Rods 131 are connected to the plate by cotter pins on opposite sides of the rod 120 and extend guidably through holes in the lower end of the neck 60, as best shown in FIG. 3. The rod 120 extends centrally through the lower end of the neck 60, and holes are formed in the lower end of the neck for circulation purposes.

The rods 131 of the second body part of the running tool continue to extend downwardly for connection to the enlarged portion 102 of the second body portion as shown in FIG. 1B. The lower extension of the upper rod 120 also extends guidably through a central hole in the portion 102, and the part 102 has vent holes therein, similar to those formed in the lower end of the neck 60. The enlarged portion 102 is fixed lengthwise of the second body part of the running tool by resting upon an annular shoulder about each of the rods 131, and held downwardly thereon by a sleeve surrounding each rod and held in a downward position by a lower extension by another sleeve beneath the enlarged portion 70 at the upper end of the second body part.

Figure 6:
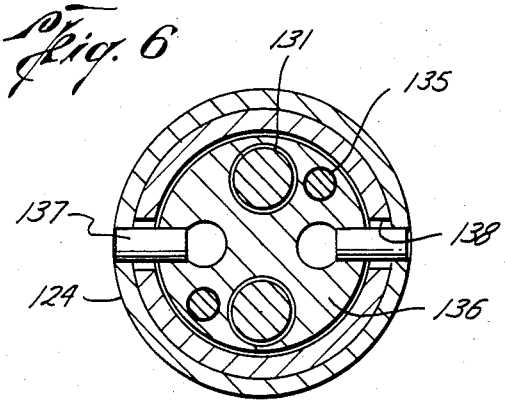
Figure 5:
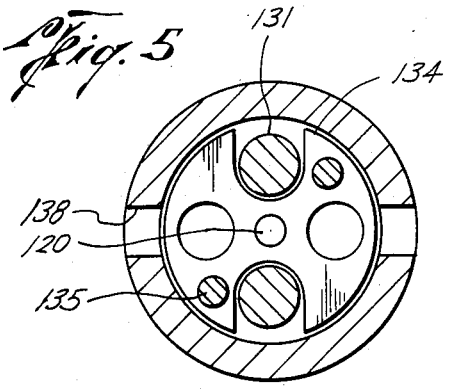

As best shown in FIG. 5, the lower extension of rod 120 is connected to a lateral plate 134 which fits within the inner diameter of the first body part of the running tool beneath the plate or the enlargement 102 on the second body part. A pair of rods 135 are connected at their upper ends to the plate and extend downwardly intermediate the rods 131 and vent holes formed in the plate 134. As shown in FIG. 6, rods 135 as well as the rods 131 extend through holes in the plate 136 which is connected to the sleeve 124 by means of pins 137 extending through holes 138 in the first body part of the landing tool.

Figure 8:
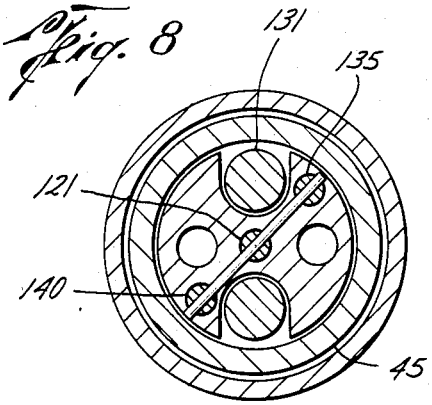

As shown in FIG. 7, the rod extensions 135 as well as the rods 131 of the second body part of the running tool also extend through holes in portions of the first body part of the running tool on opposite sides of the recess 81 formed therebetween. As shown in FIG. 8, the rod extensions 135 continue downwardly to another plate 140 having recesses through which the rods 131 extend, and connected to the upper end of the lower rod 121. The rod 121 extends through an opening in an enlarged portion 142 of the second body part of the running tool which is connected to the lower ends of pins 131 to a position above the triggers, as shown in FIG. 1C.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. For use in landing a well tool within a selected one of a plurality of vertically spaced landing nipples of a well conduit connected as part of a well string, wherein each nipple has a cylindrical bore of the same diameter as the others and a groove having an upwardly facing seat thereabout, well apparatus comprising a wire line running tool, a landing tool connectible to the running tool for raising and lowering therewith within the well string, keys each having a downwardly facing shoulder and carried by the landing tool for radial movement between inner positions in which they move past the locking grooves and outer positions in which they may move upwardly through the nipples but in which they fit within the groove of any of the nipples to land the shoulders thereof on the seat of the groove, upon downward movement, spring means carried by the landing tool for shifting between a first position urging the keys to their inner positions, as the landing tool is lowered within the conduit and until the keys are beneath the groove in a selected nipple, and a second position urging the keys to their outer positions, upon raising of the landing tool to lift the keys above the groove in the selected nipple, sensing means carried by the landing tool and urged radially outwardly to a position to engage the bore of a nipple as the landing tool is lowered to move the keys into a position opposite the groove of the selected nipple, and means on the landing tool which is responsive to movement of the sensing means into engagement with the bore and further lowering of the landing tool, following movement of the keys into the groove, for holding the keys within the locking groove of the selected nipple.

2. Well apparatus of the character defined in claim 1, wherein said running tool has laterally shiftable latching means which is released, and then relatched to permit parts of the running tool to be moved from a first to a second position in response to raising of the landing tool to lift the keys above the groove of the selected nipple, and said spring means is held in its first position until the release of laterally shiftable latching means, and thereafter shifted to its second position upon relatching of the parts of the running tool in their second position.

3. Well apparatus of the character defined in claim 2, wherein said running tool has sensing means which is urged outwardly to a position to engage a nipple bore as the keys are raised with the landing tool, and means responsive to movement of said last mentioned sensing means into engagement with the bore to release said shiftable latching means and thereby permit said spring means to be moved from its first to its second position.

4. Well apparatus of the character defined in claim 1, wherein said sensing means is engagable with the bore before the keys are lowered to a position opposite the groove of the selected nipple.

5. Well apparatus of the character defined in claim 1, wherein said sensing means returns to a non-sensing position upon return of the spring means to its first position in response to raising of the landing tool.

6. For use in landing a well tool within a selected one of a plurality of vertically spaced landing nipples of a well conduit connected as part of a well string, wherein each nipple has a cylindrical bore of the same diameter as the others and a locking groove having an upwardly facing seat thereabout, well apparatus comprising a wire line running tool, a landing tool comprising a body connectible to the running tool for raising and lowering therewith within the well string, and including a first body part and a second body part connectible to the well tool and vertically moveable between first and second relative vertical positions with respect to said first part keys each having a downwardly facing shoulder and carried by the second body part for movement between inner positions in which they move downwardly past the locking grooves, and outer positions in which they may move upwardly through the nipples, but in which they may fit within the groove of any of such nipple when disposed opposite thereto to land the shoulders thereof on the seat of the groove upon downward movement, spring means carried by the landing tool for shifting between a first position urging the keys to their inner positions as the landing tool is lowered within the conduit and until the keys are beneath the groove in a selected nipple, and a second position urging the keys to their outer positions upon raising of the landing tool to lift the keys to a position above the groove in the selected nipple, means on the landing tool which is for preventing movement of said body parts from their first to their second relative material position, upon raising of the landing tool to lift the keys to a position above the groove in the selected nipple, sensing means carried by the body and urged radially outwardly to a position to engage the bore of a nipple as the landing tool is lowered to move the keys opposite the groove of the selected nipple, and means responsive to movement of the sensing means into engagement with the bore for releasing the body parts for movement from their first to their second relative vertical position upon lowering of the running tool following movement of the keys into the groove, and means automatically responsive to movement of the body parts into their second position for holding said body parts against movement from their second to their first relative vertical position.

7. Well apparatus of the character as defined in claim 6, wherein said running tool has laterally shiftable latching means which is released, and then relatched to permit parts of the running tool to be moved from a first to a second position in response to raising of the landing tool to lift the keys above the groove of the selected nipple, and said spring means is held in its first position until the release of laterally shiftable latching means, and thereafter shifted to its second position upon relatching of the parts of the running tool in their second position.

8. Well apparatus as defined in claim 7, wherein said running tool has sensing means which is urged outwardly to a position to engage a nipple bore as the keys are raised with the landing tool, and means responsive to movement of said last mentioned sensing means into engagement with the bore to release said shiftable latching means and thereby permit said spring means to be moved from its first to its second position.

9. Well apparatus of the character as defined in claim 6, wherein said sensing means is engagable with the bore, before the keys are lowered to a position opposite the groove in the bore.

10. Well apparatus of the character as defined in claim 6, wherein said sensing means returns to a non-sensing position upon return of the spring means to its first position in response raising of the landing tool

11. For use in landing a well tool within a selected one of a plurality of vertically spaced landing nipples of a well conduit connected as part of a well string, wherein each nipple has a cylindrical bore of the same diameter as the others and a locking groove having an upwardly facing seat thereabout, well apparatus comprising a wire line running tool, a landing tool having a body connectible to the running tool for raising and lowering therewith within the well string and including a first body part and a second body part connectible to the well tool and vertically moveable between first, second and third relative vertical positions with respect to the first part, keys each having a downwardly facing shoulder and carried by the second body part for movement between inner positions in which they move downwardly past the locking grooves and outer positions in which they may move upwardly through the nipples, but in which they fit within the groove of any of such nipples when disposed opposite thereto, to land the shoulders thereof movement, on the seat of the groove upon downward movement, spring means carried by the landing tool for shifting between positions urging the keys to their inner positions, when the body parts are in their third relative vertical position, and to their outer positions, when the body parts are in their first relative vertical position, and means on the first body part for holding the keys within the groove upon movement of said body parts from their first to their second relative vertical position, means for holding the body parts in their third relative position, as the landing tool is lowered within the well conduit and until the keys thereof are beneath the groove in a selected nipple, and then moving the body parts from their third to their first relative vertical position means for preventing movement of said body parts from their first to their second relative vertical position, in response to raising of the running tool to lift the keys to a position above the groove in the selected nipple, sensing means carried by the second body part and urged radially outwardly to a position to engage the bore of a nipple as the running tool is lowered to move the keys opposite the groove of the selected nipple.

means on the landing tool which is responsive to movement of the sensing means into engagement with the bore for releasing the body parts for movement from their first to their second relative vertical position upon lowering of the running tool following movement of the keys into the groove, and means automatically responsive to movement into their second position for holding said body parts against movement from their second to their first relative vertical position.

12. Well apparatus of the character defined in claim 11, wherein the running tool has means including laterally shiftable latching means for holding the body parts of the landing tool against movement from their third to their first relative vertical position, as the locking keys are lowered in their inner positions past said locking groove, and then releasing said body parts for movement from their third to their first relative vertical position and relatching them against movement from their first to their third relative vertical position in response to raising of said landing tool to lift said keys above said groove.

13. Well apparatus of the character defined in claim 12, including sensing means carried by the running tool and urged outwardly to engage the bore of a nipple as the landing tool is raised from a position in which the keys are below the groove in the selected nipple, and means on the running tool which is responsive to movement of said last mentioned sensing means into engagement with the bore to release said latching means and thereby permit said body parts to be moved from their third to their first relative vertical position.

14. Well apparatus of the character defined in claim 11, wherein the running tool comprises a body having first and second body parts vertically movable with respect to another between first and second relative vertical positions, a neck connectible to a wire line for raising and lowering therewith within the well string, means supporting the first body part from the neck for vertical movement with respect thereto between first and second relative vertical positions, means supporting the second body part from the neck when the body parts are in their first and third relative vertical positions and permitting the neck to be lowered with respect to the second body part upon movement of the body parts to their second relative vertical position, means on the first body part of the running tool for latching it to the first part of the landing tool, means on the second body part of the running tool for latching it to the second part of the landing tool, means on the first and second body parts of the running tool for releasable latching them against movement from their first relative vertical position to their second relative vertical position, when the neck is raised with respect to the first body part, to move the body parts of the landing tool from their third to their first relative vertical position, means for releasing the second body part of the running tool from the first part to permit it to be raised with the neck from its first to its second relative vertical movement with respect to the first body part of the running tool, so as to move the body parts of the landing tool to their second relative vertical position, as the neck is moved from its first to its second relative vertical position, and then relatching the second body part of the running tool against movement from said second to said first position with respect to the first body part, said neck being lowerable with respect to said first body from their second to their first vertical part position, and said first body part then being lowerable with the neck from its second to its third relative vertical position with respect to said second body part, when said second body part is supported through its latching means to the other part of the landing tool, and means for releasing the means latching said first and second parts of the running tool from the first and second tool parts of the landing tool automatically in response to movement of the first and second body parts of the landing tool to their second relative vertical position.

15. Well apparatus of the character as defined in claim 14, wherein the running tool includes sensing means carried by the first body part for engaging the bore of a nipple, and means carried by the first body part for engaging the well conduit to resist raising of the first body part therein, as the sensing means is engaging the bore, and said releasing means releases the second body part to be raised with respect to the neck in response to engagement of the sensing means of the running tool with the bore,

16. Well apparatus of the character defined in claim 14, including means on the running tool and engagable by a tool lowerable into the well conduit for releasing the means releasably latching the running tool from the landing tool in the event said running tool is not released in response to movement of the body parts of the landing tool into their second relative vertical position.

17. Well apparatus tool of the character defined in claim 16, wherein the releasing means includes an elongate member mounted for vertical reciprocation with respect to the second body part of the running tool between an upper position and a lower position in which it engages and moves the means releasably latching the body parts of the running tool to the body parts of the landing tool to unlatching position, and means releasably connecting the member to the second body part of the running tool in its upper position, said member having a part engagable by a tool lowered into the well string to release said connecting means and move said member to its lower position.

18. Well apparatus of the character defined in claim 11, wherein said sensing means is engagable with the bore before the keys are lowered to a position opposite the groove of the selected nipple.

19. Well apparatus of the character defined in claim 11, wherein said sensing means is automatically returned to a nonsensing position upon raising of the landing tool to move the body parts of the landing tool from their first to their third relative vertical position.

20. For use in landing a well tool within a selected one of a plurality of vertically spaced landing nipples of a well conduit connected as part of a well string, wherein each nipple has a cylindrical bore of the same diameter as the others and a locking groove having an upwardly facing seat thereabout, a landing tool comprising a body adapted to be connected to a wire line running tool in order to be raised and lowered therewith within the well string, and having a first body part and a second body part connectible to the well tool and vertically moveable with respect to the first part between first, second and third relative vertical positions, keys each having a downwardly facing shoulder and carried by the second body part for movement between inner, positions in which they may move downwardly past the locking groove and outer positions in which they may move upwardly through the nipples, but in which they may fit within the groove of any of such nipples when disposed opposite thereto to land the shoulder thereof on the seat of the groove, upon downward movement, spring means shiftable between a first position urging the keys to their inner positions, when the body parts are in their third relative vertical position, and a second position urging the keys to their outer positions, when the body parts are in their first relative vertical position, sensing means carried by the second body part for radial movement between an inner position and an outer position protruding from said first body part in order to engage the bore of a nipple, means on the first body part for yieldably urging the sensing means from its inner to its outer position and for preventing movement of said body parts to their second position when the body parts are in their first position, means responsive to movement of said sensing means into engagement with the bore to release said body parts for movement from said first to said second relative vertical position, upon lowering of the landing tool following landing of the keys in the groove, means on the first body part for holding the keys within the locking groove upon movement of said body parts from their first to their second relative vertical position, and means on the body parts automatically responsive to movement in their second relative vertical position for holding said body parts against movement from their second to their first relative vertical position.

21. A landing tool of the character defined in claim 20, wherein said holding means comprises latches on the second part laterally shiftable into a position latching said first body part in its second position.

22. A landing tool of the character defined in claim 21, wherein said yieldable urging means comprises a C-ring carried for radial movement within a groove about the first body part.

23. For use in landing a well tool within a selected one of a plurality of vertically spaced landing nipples of a well conduit connected as part of a well string, wherein each nipple has a cylindrical bore of the same diameter as the others and a locking groove having an upwardly facing seat thereabout, a running tool comprising a body having first and second body parts vertically movable with respect to another between first and second relative vertical positions, a neck connectible to a wire line for raising and lowering therewith within the well string, means supporting the first body part from the neck for vertical movement with respect thereto between first and second relative vertical positions, means supporting the second body part from the neck when the body parts are in their first and third relative vertical positions and permitting the neck to be lowered with respect to the second body part upon movement of the body parts to their second relative vertical position, means on the first body part for latching it to one part of a landing tool, means on the second body part for latching it to another part of the landing tool, means on the first and second body parts for releasable latching them against movement from their first relative vertical position to their second relative vertical position, when the neck is raised with respect to the first body part, sensing means carried by the first body part for engaging the bore of a nipple, means carried by the first body part for engaging the well conduit to resist raising of the first body part therein, as the sensing means is engaging the bore, and means responsive to engagement of the sensing means with the bore for releasing the second body part to be raised with the neck from its first to its second relative vertical movement with respect to the first body part, as the neck is moved from its first to its second relative vertical position, and then relatching the body parts against movement from said second with respect to the first body part, said neck being lowerable with respect to said first body from their second to their first vertical part position, and said first body part then being lowerable with the neck from its second to its third relative vertical position with respect to said second body part, when said second body part is supported through its latching means to the other part of the landing tool.

24. A running tool of the character defined in claim 23, wherein the well conduit engaging means comprises dogs carried by the first body part for movement between positions in which they move downwardly through the conduit but engage a downwardly facing shoulder in the nipple when raised therein.

25. A running tool of the character defined in claim 24, including detent means on the neck and first body part for releasably holding the neck in its second position with respect to the first body part.

26. A running tool of the character defined in claim 23, wherein the means for latching and relatching comprises a C-ring carried by the second body part for urging the sensing means inwardly to sensing position, when the body parts are in their first relatively vertical position, and being outwardly yieldable upon movement of the sensing means into a bore to release said body parts for movement to their second relative vertical position.

27. A running tool of the character defined in claim 26, wherein the C-ring is carried within a groove about the second body parts for expansion and contraction into and out of positions above and below shoulders on the first part.

28. A running tool of the character defined in claim 26, including an elongate member mounted for vertical reciprocation with respect to the body between an upper position and a lower position in which it engages and moves the latching means to unlatching position, and means releasably connecting the member to the body in its upper position, said member having a part engagable by a tool lowered into the well string to release said connecting means and move said member to its lower position.

29. For use in landing a well tool within a selected one of a plurality of vertically spaced landing nipples of a well conduit connected as part of a well string, wherein each nipple has a cylindrical bore of the same diameter as the others and a locking groove having an upwardly facing seat thereabout, well apparatus comprising a wire line running tool, a landing tool comprising a first body part and a second body part vertically movable between first and second relative vertical position with respect to said first part said running tool having first and second body parts which are vertically movable with respect to one another between first and second relative vertical positions, said first part being connectible to the wire line tool for raising and lowering therewith and said second part being supported from the wire line tool for vertical movement with respect thereto, means for releasably latching the first part of the running tool to the first part of the landing tool, means for releasably latching the second part of the running tool to the second part of the landing tool, keys each having a downwardly facing shoulder and carried by the second body part of the landing tool for movement between inner positions in which they move downwardly past the locking grooves, and outer positions in which they may move upwardly through the nipples, but in which they may fit within the groove of any of such nipple when disposed opposite thereto to land the shoulders thereof on the seat of the groove upon downward movement, spring means carried by the landing tool for shifting between a first position urging the keys to their inner positions as the landing tool is lowered within the conduit and until the keys are beneath the groove in a selected nipple, and a second position urging the keys to their outer positions upon raising of the landing tool with the running tool to lift the keys to a position above the groove in the selected nipple, means for preventing movement of said body parts of the landing tool from their first to their second relative vertical position, upon raising of the landing tool to lift the keys to a position above the groove in the selected nipple, means for releasing the body parts of the landing tool for movement from their first to their second relative vertical position in which said keys are held by one of said body parts within the groove of the selected nipple upon lowering of the landing tool with the running tool following movement of the keys into the groove, and means for holding said body parts against movement from their second to their first relative vertical position, and for releasing said clamping means to permit the running tool to be retrieved from the landing tool, automatically in response to movement of the running tool parts into their second position upon lowering of the first part of the running tool with respect to the second part thereof.

* * * * *